US006427417B1

(12) United States Patent
Sagy

(10) Patent No.: US 6,427,417 B1
(45) Date of Patent: Aug. 6, 2002

(54) ELEMENTS AND METHOD FOR RETAINING WALL STRUCTURES

(76) Inventor: Eyal Sagy, 256 Havarkon Street, Tel-Aviv (IL), 63504

( * ) Notice: Subject to any disclaimer, the term of this patent is extended or adjusted under 35 U.S.C. 154(b) by 0 days.

(21) Appl. No.: 09/478,441

(22) Filed: Jan. 6, 2000

(30) Foreign Application Priority Data

Jan. 7, 1999 (IL) ..... 127962

(51) Int. Cl.[7] ..... E02D 29/02

(52) U.S. Cl. ..... 52/741.13; 52/223.13; 52/169.1; 52/169.8; 52/166; 405/262; 405/284

(58) Field of Search ..... 52/231, 169.1, 52/169.4, 169.8, 223.13, 166, 741.13; 405/259.1, 259.2, 259.4, 262, 284, 286

(56) References Cited

U.S. PATENT DOCUMENTS 5,253,959 A 10/1993 MacDonald et al.
5,525,014 A * 6/1996 Brown ..... 405/262
5,921,715 A 7/1999 Rainey
6,042,301 A * 3/2000 Sovran ..... 402/112
6,113,316 A * 9/2000 Ash ..... 405/262

FOREIGN PATENT DOCUMENTS

EP 0 343 913 11/1989

OTHER PUBLICATIONS

Patent Abstracts of Japan, No. 01260120, Oct. 17, 1989.
Patent Abstract of Japan, No. 57021625, Feb. 4, 1982.
Patent Abstracts of Japan, No. 62264216, Nov. 17, 1987.

* cited by examiner

*Primary Examiner*—Carl D. Friedman
*Assistant Examiner*—Jennifer I. Thissell
(74) *Attorney, Agent, or Firm*—Lowe Hauptman Gilman & Berner, LLP

(57) ABSTRACT

The invention provides a wall-retaining element, including a three-dimensional body having a bottom portion including a major base surface positionable upon the ground in spaced-apart relationship to a wall to be retained, such that the plane of the bottom portion traverses the plane of the wall; at least one major surface to be covered with soil for applying pressure to the element, and means for attaching one end of a tie rod or a cable to the element and for attaching its other end to the wall. The invention also provides a method for retaining a wall structure.

12 Claims, 2 Drawing Sheets

ELEMENTS AND METHOD FOR RETAINING WALL STRUCTURES

FIELD OF THE INVENTION

The present invention relates to the field of retaining wall structures, and more particularly to elements for retaining wall structures, and to a method for retaining walls.

BACKGROUND OF THE INVENTION

Various techniques for retaining walls are known. According to one such technique, wall elements are anchored to the ground by means of suitable strips, nets or cables. This technique necessitates, however, the existence of solid ground in the vicinity of the wall, into which ground an anchoring unit is anchored. Another technique utilizes anchor units attached to the wall by means of tie members. The disadvantage of this technique resides in the fact that the stability of the wall depends mainly on the resistant force of the filling soil or backfill behind the wall and the anchor units. This force constitutes only a small portion of the weight of the backfill, and therefore there is no real utilization of the backfill's potential weight in supporting the wall.

SUMMARY OF THE INVENTION

It is therefore a broad object of the present invention to ameliorate the disadvantages of prior art techniques for building retaining walls and to provide elements for retaining walls which are operable to enhance their stability.

It is a further object of the present invention to provide wall-retaining elements having superior anchoring capabilities and which are suitable for utilization in retaining walls having limited backfill space.

In accordance with the present invention, there is therefore provided a wall-retaining element comprising a three-dimensional body having a bottom portion including a major base surface positionable upon the ground in spaced-apart relationship to a wall to be retained such that the plane of said bottom portion traverses the plane of the wall; a major surface to be covered with soil for applying pressure to said element, and means for attaching one end of a tie rod or a cable to said element and for attaching its other end to said wall.

The invention further provides a method for retaining a wall structure, said method comprising providing a wall-retaining element comprising a three-dimensional body having a bottom portion including a major base surface positionable upon the ground in spaced-apart relationship to a wall to be retained such that the plane of said bottom portion traverses the plane of the wall; a major surface to be covered with soil for applying pressure to said element, and means for attaching one end of a tie rod or a cable to said element and for attaching its other end to said wall; positioning said element at a distance from the wall to be retained; connecting a portion of said wall to said element by means of a tie rod or cable; and covering said element with soil, so that, upon the application of a tensioning force to said tie rod or cable, the element will tend to move in a direction against the force applied to the major surface of said element by the soil, thereby retaining said wall structure.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENTS

Figure 1:
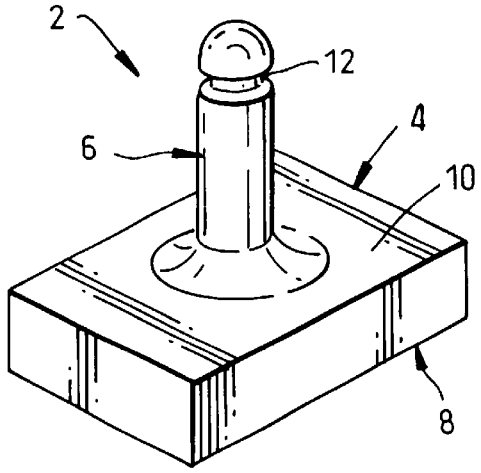
FIG. 1 is a perspective view of a first embodiment of a wall-retaining element according to the present invention.

There is seen in FIG. 1 a wall-retaining element 2, being a three-dimensional body having a bottom portion 4 and a top portion 6 made integrally with, or attached to, the bottom portion 4. The bottom portion 4 is configured as a multilateral body or prism, or alternatively, may be polymorphous. Irrespective of its exact configuration, the bottom portion 4 has a major base surface 8 which is positionable on the ground, and an opposite top surface 10. Upper portion 6 generally protrudes from upper surface 10 and may also take different forms. It may be a cylindrical rod, as shown in FIG. 1, or a cone, pyramid, or the like. Upper portion 6 is provided with connecting means 12, e.g., an annular groove, facilitating the attachment thereto of a tie rod or cable.

Figure 2:
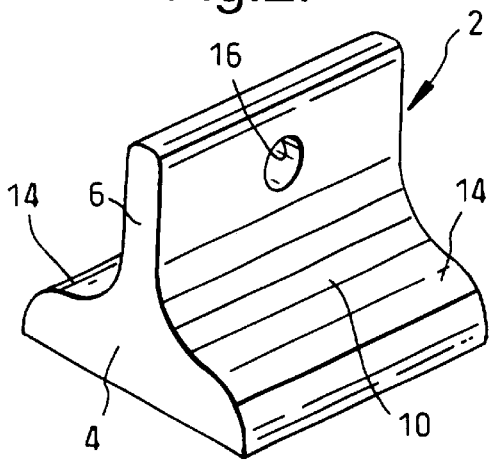
FIGS. 2 to 7 are perspective views of various possible further embodiments of wall-retaining elements according to the present invention.

Referring to FIG. 2, there is shown an element 2 having rounded upper shoulders 14 merging into the upper portion 6, which in this embodiment is generally shaped as a plate extending along the entire top surface 10 of bottom portion 4. In this embodiment, the means 12 for attaching a tie rod or cable is a hole formed in upper portion 6.

While in FIGS. 1 and 2, the upper portion 6 is symmetrically disposed with respect to the bottom portion 4, it may be located closer to one edge of the bottom portion than to an opposite edge, without detracting from the effectiveness of the element in retaining the wall to which it is attached.

Figure 3:
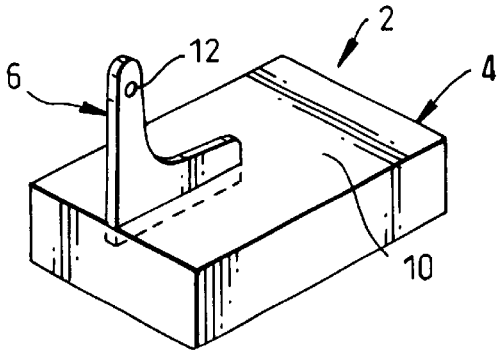

In the embodiment of FIG. 3, the upper portion 6 is an L-shaped plate asymmetrically embedded in the bottom portion 4 at one of its edges. Connecting means 12, in the form of a hole for attaching a tie rod or cable, is also provided.

Figure 4:
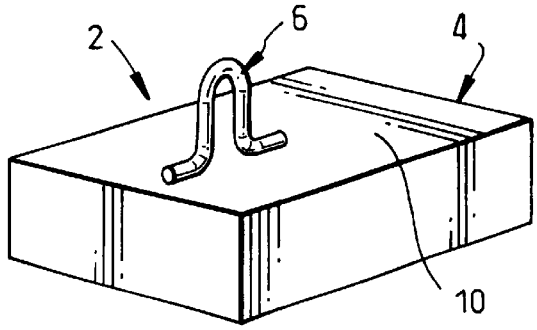

A further embodiment is illustrated in FIG. 4, in which the upper portion 6 is configured as a loop, also asymmetrically embedded in, or otherwise attached to, the bottom portion 4.

Figure 5:
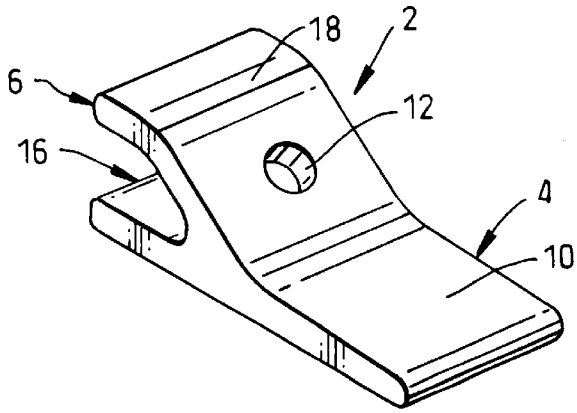

In FIG. 5, there is illustrated a still further embodiment of element 2, in which the upper portion 6 is generally plate-shaped and extends at an angle from the top surface 10 of bottom portion 4 so as to overlap a part thereof. This configuration forms an open space 16 between the upper and bottom portions of element 2, thereby effectively increasing the overall area of the element's soil-bearing surfaces and providing an additional surface area 18 upon which soil can be piled.

Figure 6:
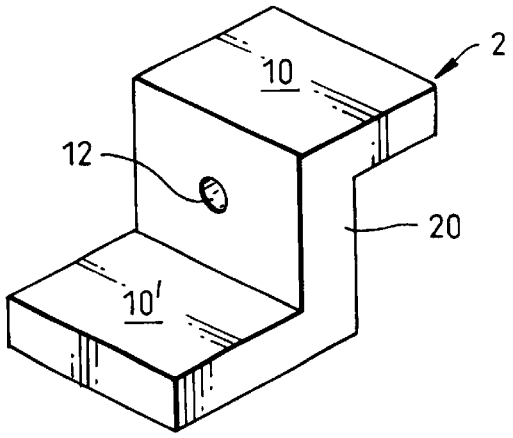

FIG. 6 illustrates an embodiment of generally Z-shaped element 2, in which there are two laterally displaced, major surfaces 10 and 10' disposed in different planes, which planes are interconnected by a vertically extending portion 20. Connecting means 12 is formed in portion 20 for attaching a tie rod or cable.

Figure 7:
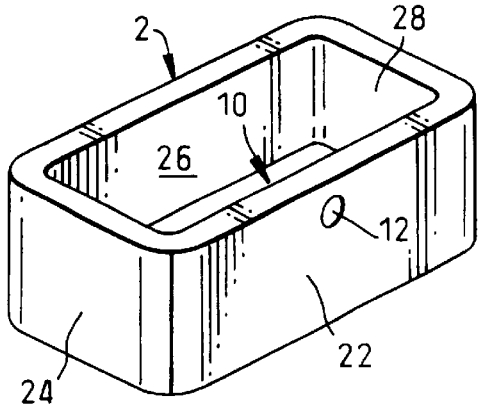

In the box-shaped element 2 shown in FIG. 7, the major surface to be covered with soil is the upper surface of the bottom wall of the box, surrounded by lateral walls 22, 24, 26, 28. Connecting means 12 for attaching a tie rod or cable is made in wall 22.

Figure 8:
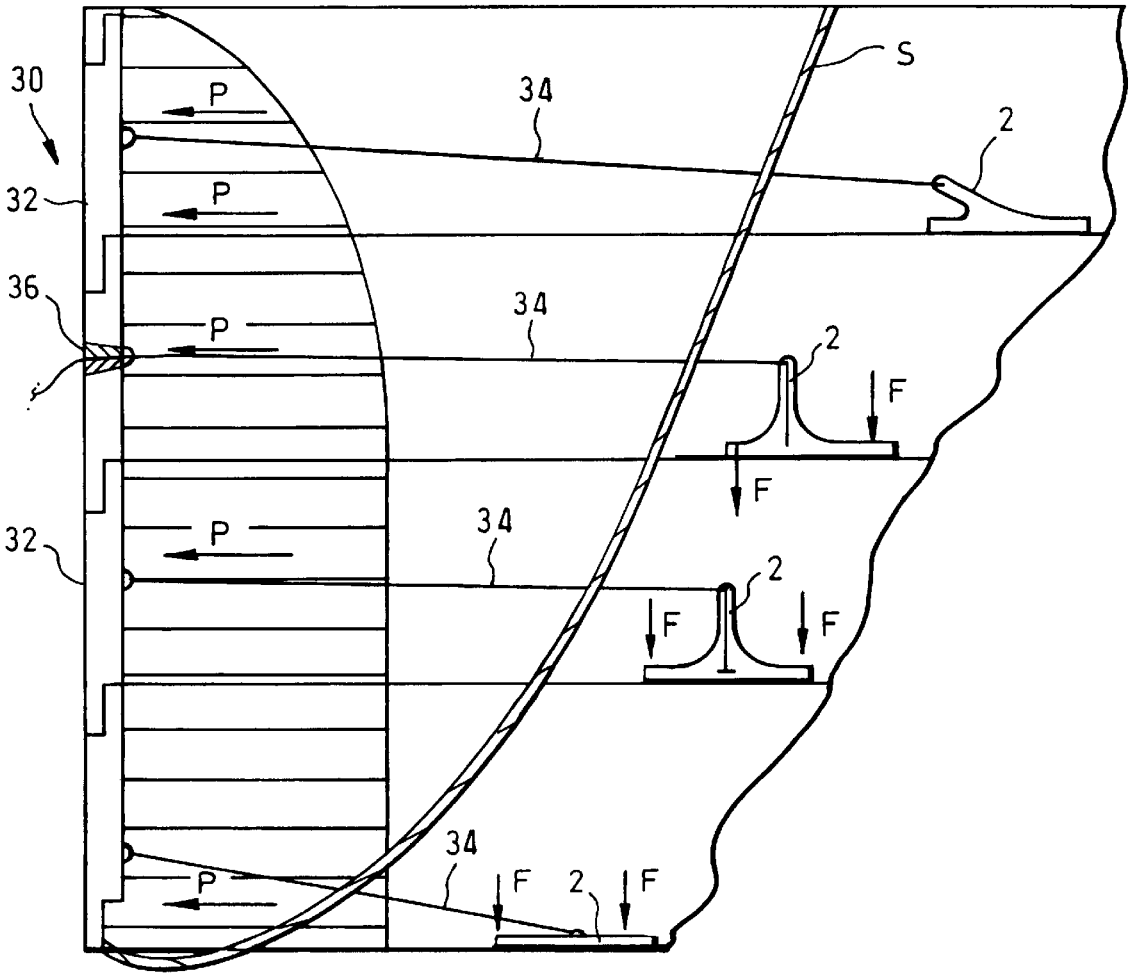
FIG. 8 is a schematic representation of the manner of utilizing various elements according to the present invention.

Turning now to FIG. 8, examples are shown of the manner in which the various types of wall-retaining elements are utilized in practice. Shown are a wall 30 made of modular face units 32, the destruction plane S and the pressures P applied on the wall by the backfill. Further indicated in FIG. 8 are the additional forces F applied by the backfill on the upper surfaces of the elements 2, which thereby increase the wall's stability. Face units 32 are connected to elements 2 by means of tie rods or cables 34, extending perpendicular or angular to the wall. Obviously, not all of the wall's face units need to always be anchored. One of the face units may be anchored to more than one element, and vice versa, one element may be anchored to more than one face unit.

Advantageously, the tie rods or cables are tensioned by any per se known means and method, during or after erection of the wall. This can be effected from the outer side of the wall 30 by a chock, a chuck or like means 36, and/or by simple clamping means at the element end of the tie rod or cable. The elements 2 may also be pre-tensioned such that their base surfaces will be slightly tilted towards the vertical plane of the wall. Upon pouring of the backfill soil thereon, the weight of the soil will apply sufficient pressure on the upper surfaces of the elements to rotate the elements about their connecting points with the tie rods or cables, back to the angular position wherein their base surfaces reassume a position substantially normal to the plane of the wall.

The location of the means for attaching the tie rod or cable to an element 2 is chosen such that, in use, when the other end of the tie rod or cable is attached to the wall and the wall portion to which it is attached moves away from the element and tensions the tie rod or cable, this movement will create and apply upon the element a force which will try to tilt the base surface of the element in the direction in which it will assume a disposition parallel to the plane of the wall. This force will be reacted upon by forces F (FIG. 8) stemming from the weight of the backfill, which will oppose the movement of the element and, in turn, of the wall. Hence, such an element provides an anchor which is not only held in position due to frictional forces, but also mainly due to the weight applied by the backfill on the upper surface of the element.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A method for retaining a wall structure, said method comprising the steps of:

providing a wall-retaining element including a three-dimensional anchoring body comprising a base portion having a bottom surface positioned in parallel with the ground and a top surface, an upper portion extending upwardly from said base portion and an attaching point in said upper portion, said attaching point being elevated above said bottom and top surfaces;

positioning said element at a distance from the wall structure to be retained;

connecting a portion of said wall structure to said attaching point by means of a tie rod or cable; and covering the top surface of said base portion with a backfill material to compensate for a tensioning force occurring in said tie rod or cable that would otherwise tend to tilt said base portion toward the wall structure, thereby retaining said wall structure.

2. The method as claimed in claim 1, wherein said element is pre-tensioned prior to, during, or after it is covered with the backfill material.

3. The method as claimed in claim 1, wherein said element is positioned with the bottom surface of said base portion slightly tilted toward the wall structure before covering the top surface of said base portion with the backfill material to both compensate for said tensioning force and reposition said element so that the bottom surface of said base portion assumes a position substantially normal to the wall structure.

4. The method as claimed in claim 1, wherein said portion of said w all structure is attached to the attaching point of said element by a cable.

5. A wall construction, comprising:

a wall erected on a ground by a plurality of modular units each of said units having a front face and a back face;

at least one wall-retaining element placed spaced from the wall and comprising a base portion and an upper portion, said base portion having a bottom surface positioned in parallel with the ground, and a top surface covered with a backfill material filled behind the wall;

an attaching point being made in said upper portion to be elevated above said bottom and top surfaces; and at least one attaching member for attaching said attaching point to the back face of at least one of said modular units;

wherein a tension occurring in the attaching member as a result of a force applied on said at least one of said modular units and tending to tilt the base portion toward the wall, is compensated for by pressure applied upon the top surface of the base portion by the weight of the backfill material, thereby retaining said at least one of said modular units within the wall.

6. The wall construction of claim 5, wherein the upper portion is fixedly connected to or integrally formed on the top surface of the base portion.

7. The wall construction of claim 6, wherein the upper portion is positioned symmetrically with respect to the base portion.

8. The wall construction of claim 7, wherein the upper portion extends smoothly upwardly from opposite edges of the top surface of the base portion toward a central region thereof.

9. The wall construction of claim 5, further comprising multiple wall-retaining elements disposed on different levels of elevation, each of said multiple wall-retaining elements being positioned co-elevational with and attached to one or more of said modular units.

10. The wall construction of claim 5, wherein said at least one wall-retaining element is placed spaced from the wall with a close end of said wall-retaining element being closer to the wall than a distal end of said wall-retaining element, and said tension tends to rotate the distal end of said wall-retaining element about the close end thereof toward the wall.

11. The wall construction of claim 5, wherein the attaching member is a rod.

12. A wall construction, comprising:

a wall erected on a ground by a plurality of modular units each having a front face and a back face;

at least one wall-retaining element placed spaced from the wall and comprising an attaching point, and a base portion having a bottom surface positioned in parallel with the ground, and a top surface covered with a backfill material filled behind the wall; and at least one attaching member for attaching the attaching point of the wall-retaining element to the back face of at least one of said modular units;

wherein a tension, occurring in the attaching member as a result of a force applied on said at least one of said modular units, and tending to tilt the base portion toward the wall, is compensated for by a pressure applied upon the top surface of the base portion by the weight of the backfill material, thereby retaining said at least one of said modular units within the wall; and wherein the attaching member is a cable.

* * * * *